US008468861B2

(12) United States Patent
Pukari et al.

(10) Patent No.: US 8,468,861 B2
(45) Date of Patent: Jun. 25, 2013

(54) ELECTROMECHANICAL LOCK AND ITS KEY

(75) Inventors: Mika Pukari, Oulu (FI); Toivo Pääkkönen, Nakertaja (FI); Hannu Jokinen, Oulunsalo (FI); Petteri Karjalainen, Kajaani (FI)

(73) Assignee: ILOQ Oy, Oulu (FI)

( * ) Notice: Subject to any disclaimer, the term of this patent is extended or adjusted under 35 U.S.C. 154(b) by 90 days.

(21) Appl. No.: 12/669,209

(22) PCT Filed: Jul. 16, 2008

(86) PCT No.: PCT/FI2008/050435

§ 371 (c)(1),
(2), (4) Date: Jan. 15, 2010

(87) PCT Pub. No.: WO2009/010638

PCT Pub. Date: Jan. 22, 2009

(65) Prior Publication Data

US 2010/0139343 A1 Jun. 10, 2010

(30) Foreign Application Priority Data

Jul. 18, 2007 (EP) ..... 07112676

(51) Int. Cl.
*E05B 47/00* (2006.01)

(52) U.S. Cl.
USPC ..... 70/278.7; 70/252; 70/263; 70/278.2; 70/283.1; 70/279.1; 340/5.6; 340/5.67; 307/9.1; 307/10.1

(58) Field of Classification Search
USPC ..... 70/252, 263, 277, 278.2, 278.3, 278.7, 70/279.1, 283.1; 307/9.1, 10.1; 340/5.6–5.67
See application file for complete search history.

(56) References Cited

U.S. PATENT DOCUMENTS

| | | | | | |
|---|---|---|---|---|---|
| 4,352,278 | A | * | 10/1982 | Neyret | 70/252 |
| 4,601,184 | A | * | 7/1986 | Doinel | 70/360 |
| 4,912,460 | A | * | 3/1990 | Chu | 340/5.67 |
| 5,132,661 | A | | 7/1992 | Pinnow | |
| 5,493,882 | A | * | 2/1996 | Jasper | 70/278.4 |
| 5,677,682 | A | * | 10/1997 | Thorsen et al. | 340/5.65 |
| 6,370,928 | B1 | * | 4/2002 | Chies et al. | 70/278.3 |
| 6,389,856 | B1 | * | 5/2002 | Watanuki et al. | 70/186 |
| 6,539,762 | B1 | * | 4/2003 | Wittwer | 70/423 |
| 6,668,606 | B1 | * | 12/2003 | Russell et al. | 70/278.3 |
| 6,776,016 | B1 | * | 8/2004 | Wittwer et al. | 70/252 |
| 7,334,441 | B1 | * | 2/2008 | Amundson et al. | 70/252 |
| 2009/0229326 | A1 | * | 9/2009 | Pukari et al. | 70/263 |

FOREIGN PATENT DOCUMENTS

| | | | | |
|---|---|---|---|---|
| DE | 3208818 | A1 | * | 9/1983 |
| DE | 19519789 | A1 | * | 12/1996 |
| DE | 19519789 | A1 | | 12/1996 |
| EP | 339102 | A | * | 11/1989 |

(Continued)

*Primary Examiner* — Lloyd Gall
*Assistant Examiner* — Ifeolu Adeboyejo
(74) *Attorney, Agent, or Firm* — Birch, Stewart, Kolasch & Birch, LLP

(57) ABSTRACT

An electromechanical lock, its key, and its operation method are disclosed. The method includes: during a first and a second insertion phases of a key, conveying mechanical power to an electric generator by a key follower and enabling mechanically operation of an actuator by the key follower; generating electric power from mechanical power by the electric generator; reading data from an external source; matching the data against a predetermined criterion; and during a removal phase of the key, returning the key follower to a starting position and mechanically resetting the actuator to the locked state.

16 Claims, 14 Drawing Sheets

FOREIGN PATENT DOCUMENTS

| | | | | |
|---|---|---|---|---|
| EP | 0339102 | A1 | | 11/1989 |
| EP | 1808816 | A1 | | 7/2007 |
| EP | 2017412 | A1 | | 1/2009 |
| EP | 2017413 | A1 | | 1/2009 |
| FR | 1321583 | | * | 3/1963 |
| FR | 1321583 | A | | 3/1963 |
| WO | WO 93/18257 | A1 | | 9/1993 |
| WO | WO 9318257 | A1 | * | 9/1993 |
| WO | WO 99/18310 | A1 | | 4/1999 |
| WO | WO 2007/068794 | A1 | | 6/2007 |
| WO | WO 2007068794 | A1 | * | 6/2007 |

* cited by examiner

ELECTROMECHANICAL LOCK AND ITS KEY

FIELD

The invention relates to an electromechanical lock, its key, and its operation method.

BACKGROUND

Various types of electromechanical locks are replacing the traditional mechanical locks. Electromechanical locks require an external supply of electric power, a battery inside the lock, a battery inside the key, or means for generating electric power within the lock making the lock user-powered. Further refinement is needed for making the electromechanical locks to consume as little electric power as possible.

BRIEF DESCRIPTION

The invention is defined in the independent claims.

LIST OF DRAWINGS

Embodiments of the present invention are described below, by way of example only, with reference to the accompanying drawings, in which FIG. 1A illustrates an embodiment of a key;

DESCRIPTION OF EMBODIMENTS

The following embodiments are exemplary. Although the specification may refer to "an", "one", or "some" embodiment(s) in several places, this does not necessarily mean that each such reference is made to the same embodiment(s), or that the feature only applies to a single embodiment. Single features of different embodiments may also be combined to provide other embodiments.

Figure 3A:
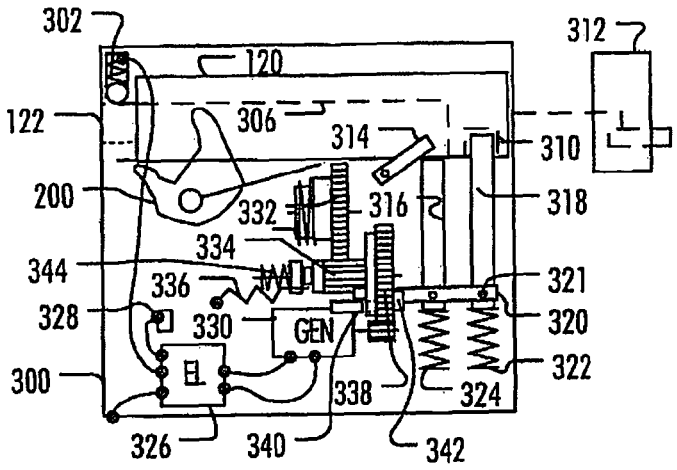
FIG. 3A illustrates an embodiment of a user-powered electromechanical lock with an integrated generator and actuator device.

With reference to FIG. 3A, the structure of an electromechanical lock 300 is explained. The lock 300 comprises an electronic circuit 326 configured to read data from an external source, and match the data against a predetermined criterion. The electronic circuit 326 may be implemented as one or more integrated circuits, such as application-specific integrated circuits ASIC. Other embodiments are also feasible, such as a circuit built of separate logic components, or a processor with its software. A hybrid of these different embodiments is also feasible. When selecting the method of implementation, a person skilled in the art will consider the requirements set for the power consumption of the device, production costs, and production volumes, for example.

The external source may be an electronic circuit configured to store the data. The electronic circuit may be an iButton® (www.ibutton.com) of Maxim Integrated Products, for example; such an electronic circuit may be read with 1-Wire® protocol. The electronic circuit may be placed in a key, for example, but it may be positioned also in another suitable device or object. The only requirement is that the electronic circuit 326 of the lock 300 may read the data from the external electronic circuit. The data transfer from the external electronic circuit to the electronic circuit 326 of the lock 300 may be performed with any suitable wired or wireless communication technique. In user-powered locks, produced energy amount may limit the techniques used. Magnetic stripe technology or smart card technology may also be used as the external source. Wireless technologies may include RFID technology, or mobile phone technology, for example. The external source may be a transponder, an RF tag, or any other suitable electronic circuit type capable of storing the data.

The data read from the external source is used for authentication by matching the data against the predetermined criterion. The authentication may be performed with SHA-1 (Secure Hash Algorithm) function, designed by the National Security Agency (NSA). In SHA-1, a condensed digital representation (known as a message digest) is computed from a given input data sequence (known as the message). The message digest is to a high degree of probability unique for the message. SHA-1 is called "secure" because, for a given algorithm, it is computationally infeasible to find a message that corresponds to a given message digest, or to find two different messages that produce the same message digest. Any change to a message will, with a very high probability, result in a different message digest. If security needs to be increased, other hash functions (SHA-224, SHA-256, SHA-384 and SHA-512) in the SHA family, each with longer digests, collectively known as SHA-2 may be used. Naturally, any suitable authentication technique may be used to authenticate the data read from the external source. The selection of the authentication technique depends on the desired security level of the lock 300 and possibly also on the permitted consumption of electricity for the authentication (especially in user-powered electromechanical locks).

The lock 300 also comprises an electric generator 330 configured to generate the electric power from mechanical power. The lock 300 is user-powered, i.e. the user generates all the mechanical and electrical power needed for operating the lock 300. The electric generator 330 may be a permanent magnet generator, for example. The output power of the electric generator 330 may depend on rotating speed, terminal resistance and terminal voltage of the electronic and the constants of the electric generator 330. The generator constants are set when the electric generator 330 is selected. The electric generator 330 may be implemented by a Faulhaber motor 0816N008S, which is used as a generator, for example. The term electric generator refers to any generator/motor capable of generating electric power from mechanical power.

FIG. 3A illustrates a solution where only one electric generator 330 is used to generate the electric power and feed the electric power to the electronic circuit 326, and thereupon move a support 342 (to a fulcrum position) with the (generated) electric power. In such a solution, the electric generator 330 is also used as an actuator of the lock; the actuator 330 may put the lock 300 in a mechanically openable state under the control of the electronic circuit 326. The support 342 may be coupled with a shaft of the electric generator 330. The shaft may be a moving shaft, a rotating shaft, for example. Later, with reference to FIGS. 6A to 6F also an embodiment is illustrated where the electric generator 606 and the actuator 608 are separate devices.

Accordingly, the lock 300 also comprises an actuator 330 powered by the electric power. The actuator 330 is configured to set the lock 300 from a locked state to a mechanically openable state. The actuator 330 is described in greater detail in another simultaneously filed application: EP 07112673.4.

The lock 300 also comprises a key follower 200 powered by the mechanical power. The key follower 200 is configured to organize timing of the lock 300 in relation to an insertion of a key as follows:

during a first insertion phase and a second insertion phase, convey the mechanical power to the electric generator 330 and mechanically enable operation of the actuator 330; and during a removal phase of the key, return to a starting position and mechanically reset the actuator 330 to the locked state.

Additionally, the key follower 200 may be configured to, during a third insertion phase, make the electronic circuit 326 electronically control the actuator 330 so as to set the lock 300 to the mechanically openable state provided that the data matches the predetermined criterion.

With this kind of timing, as much as possible of the lock 300 operations are performed with the mechanical power, and only when absolutely needed, (user-generated) electric power is consumed for the operations.

Besides organizing the timing of the operations, the key follower 200 acts as a single mechanical power input interface for the actuator 330 operations of the lock 300. The key follower 200 eliminates all possibilities to manipulate or change the order of the actuator 330 operations by the user.

It is to be noted that in the lock 300 of FIGS. 3A to 3J, i.e. in the lock 300 that uses the same device (electric generator 330) for generating electric power and actuating the lock 300, the logical order of the operations during the first and second insertion phases is the following: during the first insertion phase the mechanical power is conveyed to the electric generator 330, and during the second insertion phase operation of the actuator 330 is mechanically enabled.

However, especially in the lock of FIGS. 6A to 6F, i.e. in the lock 600 that has a separate generator 606 and an actuator 608, the logical order of the operations during the first and second insertion phases may be reversed: during the first insertion phase operation of the actuator 608 is mechanically enabled, and during the second insertion phase the mechanical power is conveyed to the electric generator 606. The first and second insertion phases and their operations may also at least partly overlap, i.e. they may be executed at least partly in parallel.

Figure 1A:
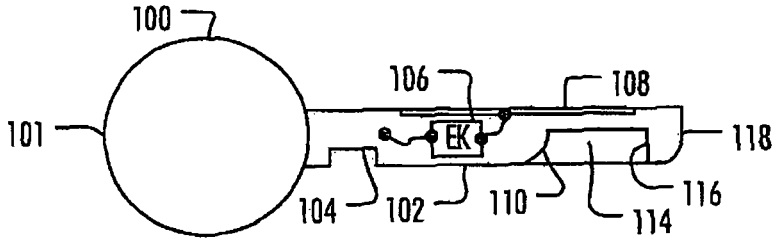
FIGS. 1B and 1C illustrate various positions of the key.
Figure 1B:
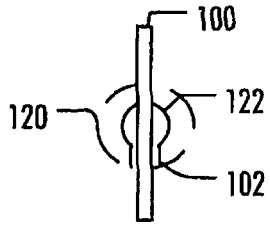
Figure 1C:
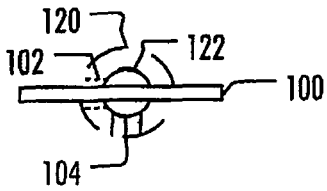

With reference to FIG. 1A, the structure of a key 100 is explained. Furthermore, FIGS. 1B and 1C illustrate positions of the key 100 in the lock 300.

The key 100 for an electromechanical lock 300 comprises a first 118 shape configured to engage, during the insertion of the key 100, with the key follower 200 of the lock 300 to mechanically transmit mechanical power produced by a user of the lock 300 to the electric generator 330 of the lock 300.

The key 100 also comprises a second shape 110 configured to make the electronic circuit 326 electronically control the actuator 330 so as to set the lock 300 to the mechanically openable state provided that data read from a source external to the lock 300 matches a predetermined criterion.

The key 100 also comprises a third shape 116 configured to engage, during a removal phase of the key 100 by the user, with the key follower 200 to return the key follower 200 to a starting position and mechanically reset the actuator 330 to the locked state.

Either the first shape 118 or the second shape 110 may also be configured to engage, during the insertion of the key 100, with the key follower 200 to mechanically enable operation of the actuator 330. In order to fit the lock 300 of FIGS. 3A to 3J, the second shape 110 is configured to engage, during the insertion of the key 100, with the key follower 200 to mechanically enable operation of the actuator 330. If the order of the operations is reversed in the lock 600 of FIGS. 6A to 6F, the first shape 118 is configured to engage, during the insertion of the key 100, with the key follower 200 to mechanically enable operation of the actuator 608.

The key 100 may also comprise a gap 114, positioned between the first shape 118 and the second shape 110, configured to provide, during the insertion of the key 100, a delay for generating electric power, and for an electronic circuit 326 of the lock 300 to read the data from the source external to the lock 300, and match the data against the predetermined criterion.

The key 100 may also comprise an electronic circuit 106 configured to store the data. As was explained earlier, the electronic circuit 106 may be an iButton®, for example.

The key 100 may be configured to engage with a lock cylinder 120 of the lock and together with the lock cylinder 120 be rotatable from a key 100 insertion position to a lock open position. The key 100 may also comprise a fourth shape 104, such as a rotating position shape, configured to engage with the lock 300 so that the key 100 is removable from the lock 300 only in the key insertion position. Correspondingly the lock 300 comprises the lock cylinder 120 configured to be rotatable from a key 100 insertion position to a lock 300 open position, and the lock 300 may be configured so that the key 100 is only removable in the key 100 insertion position.

The key 100 may also comprise various other parts. As illustrated in FIG. 1A, the key 100 may also comprise a key grip 101 and a key body 102 (in the form of a bar, for example). The key 100 may also comprise key electronics 106 connected to a sliding contact 108 and the key body 102. The key electronics 106 may comprise, as mentioned earlier, the electronic circuit for storing the data (read by the electronic circuit 326 of the lock 300). The key body 102 may also have axial guides for better positioning control.

In FIG. 1B, the key 100 is shown in a zero position. In the zero position the key 100 may be inserted in or withdrawn from the lock 300 through the keyway shape 122.

In FIG. 1C, the key 100 is rotated off the zero position. While in the off-zero position, the key body 102 and the keyway shape 122 of the lock prevent removal of the key 100.

Figure 2A:
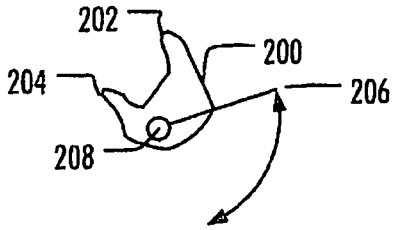
FIGS. 2A, 2B and 2C illustrate an embodiment of a key follower and its positions.
Figure 2B:
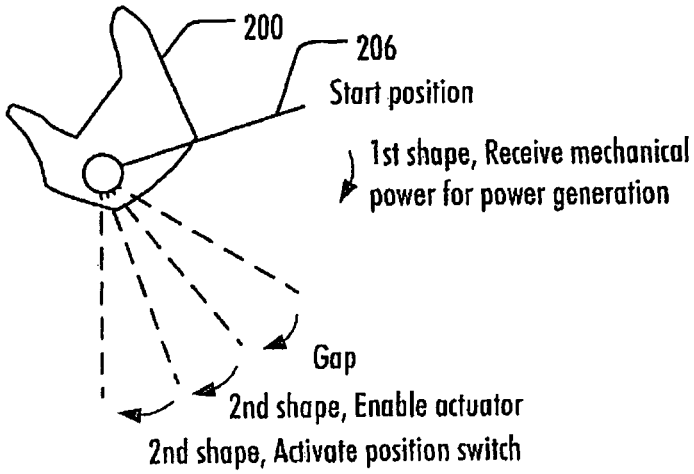
Figure 2C:
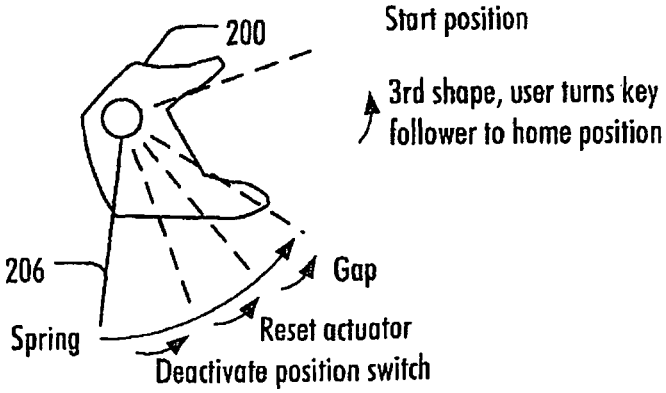

Next, with reference to FIGS. 2A, 2B and 2C the key follower 200 and its positions within the electromechanical lock are explained.

The key follower 200 may be a rotating key follower described in FIG. 2A, but also other forms may be suited for the implementation. The rotating key follower 200 may rotate around a shaft 208. As the key follower 200 of FIG. 2A is in a sense a gearwheel with two cogs, and the key 100 has the matching "cogs", this principle may be applied by the skilled person for the implementation of the key 100 and its follower 200.

The key follower 200 may comprise a first claw 202 configured to engage with the key 100 during the first insertion phase.

The key follower 200 may also comprise a second claw 204 configured to engage with the key 100 during the second insertion phase and the third insertion phase.

The key follower 200 may also comprise a swing lever 206.

Figure 3B:
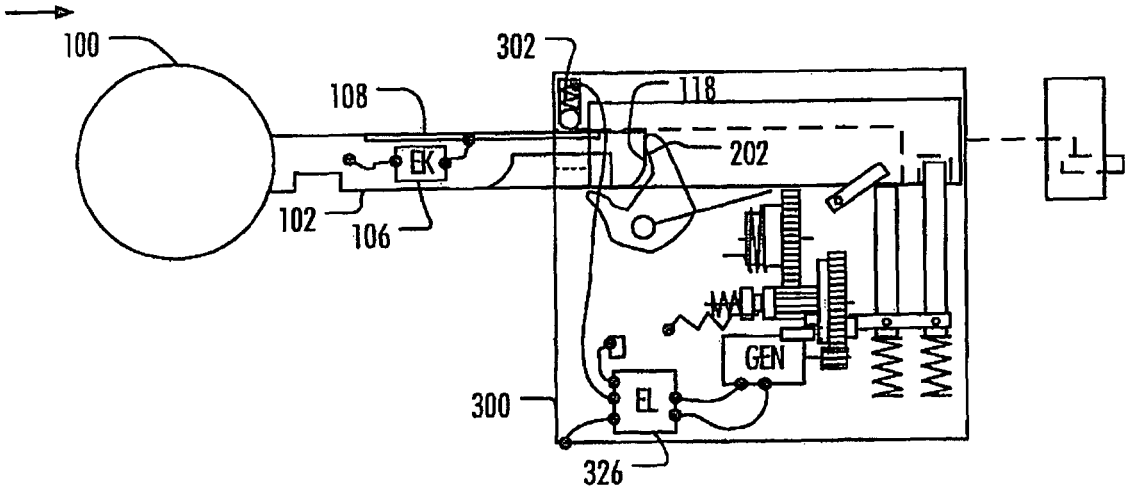
FIGS. 3B, 3C, 3D, 3E, 3F, 3G, 3H, 3I and 3J illustrate its operations.
Figure 3C:
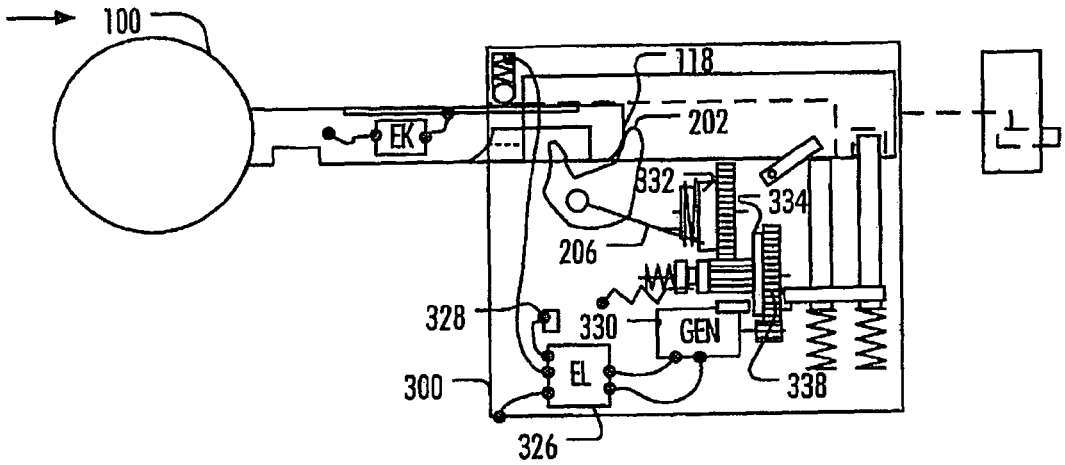
Figure 3D:
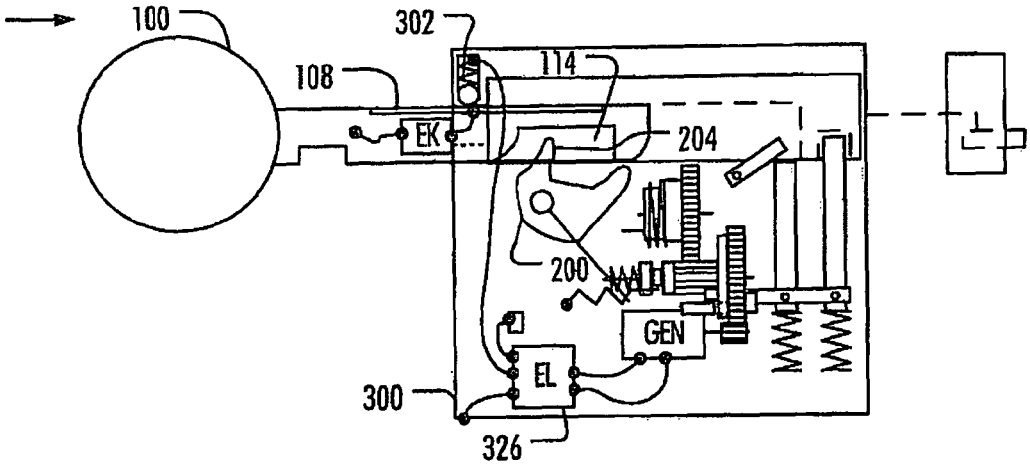
Figure 3E:
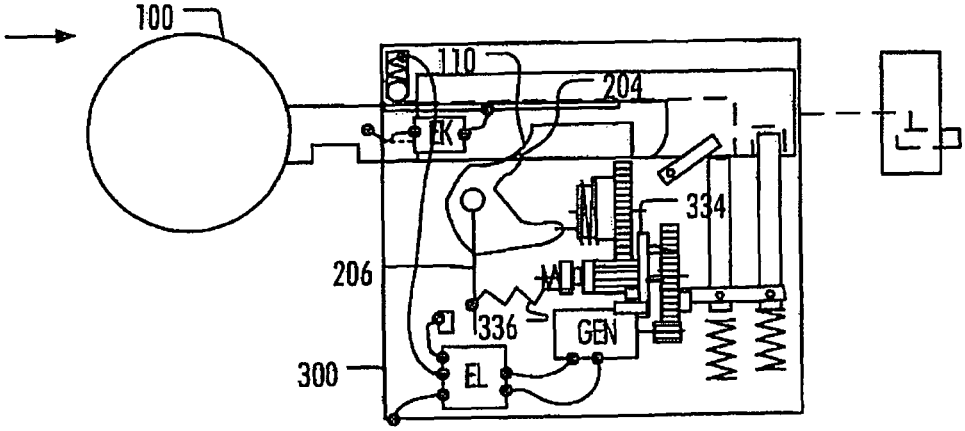
Figure 3F:
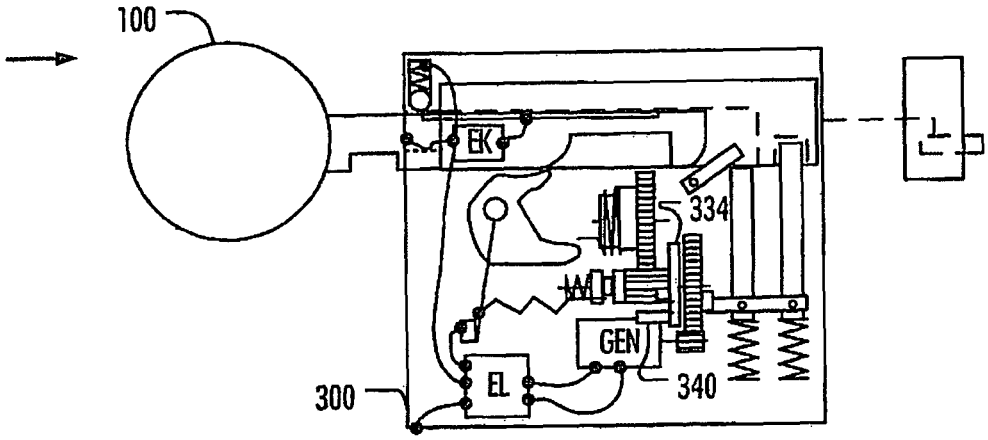
Figure 3G:
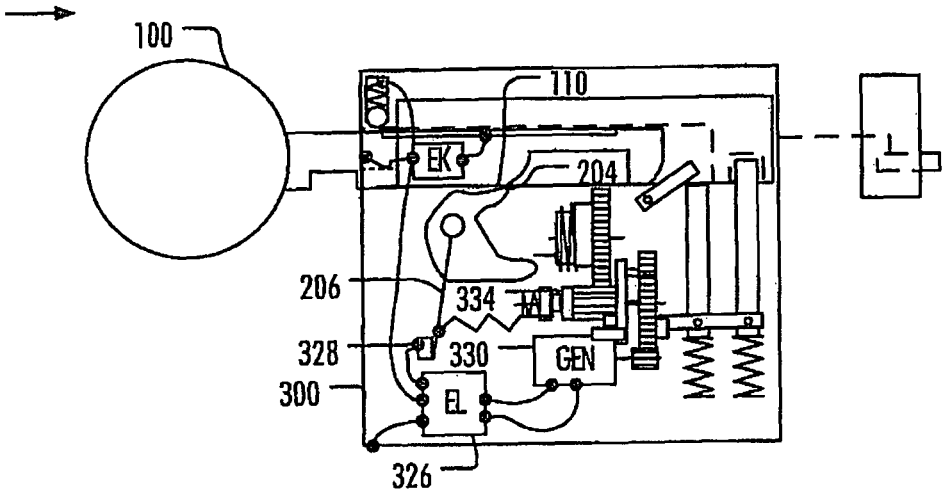
Figure 3H:
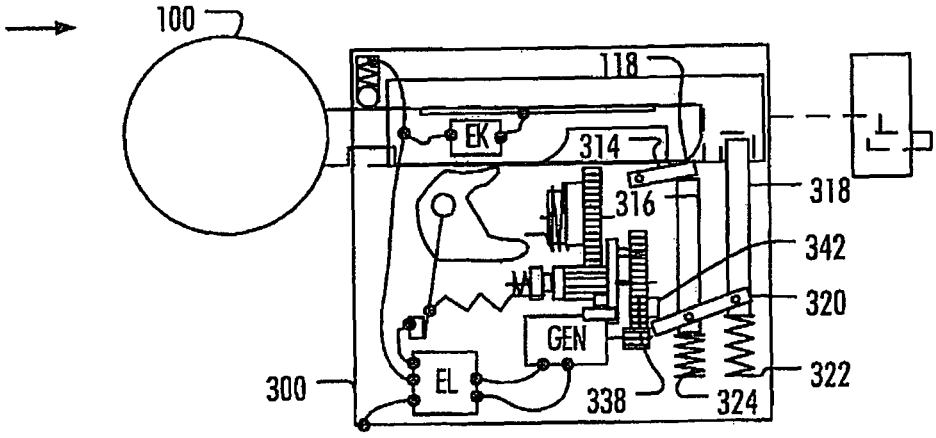
Figure 3I:
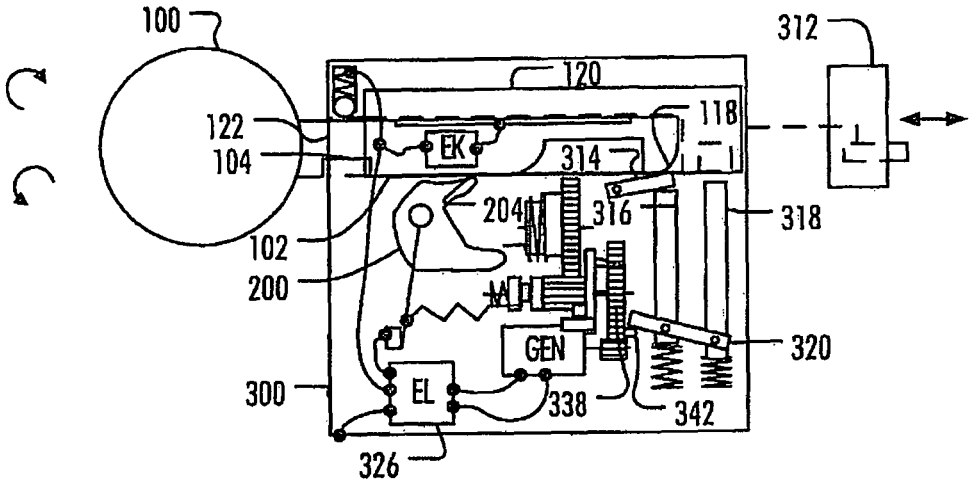

FIG. 2B illustrates the positions and functions of the key follower 200 when the key 100 is inserted into the lock 300:

FIGS. 3B and 3C will further illustrate reception of mechanical power with the first shape 118 of the key 100;

FIG. 3D will further illustrate the operation allowed by the gap 114 of the key;

FIGS. 3E and 3F will further illustrate the operation of the actuator with the second shape 110 of the key 100; and FIGS. 3G, 3H and 3I will further illustrate the operation after the position switch 328 is activated by the second shape 110 of the key.

Figure 3J:
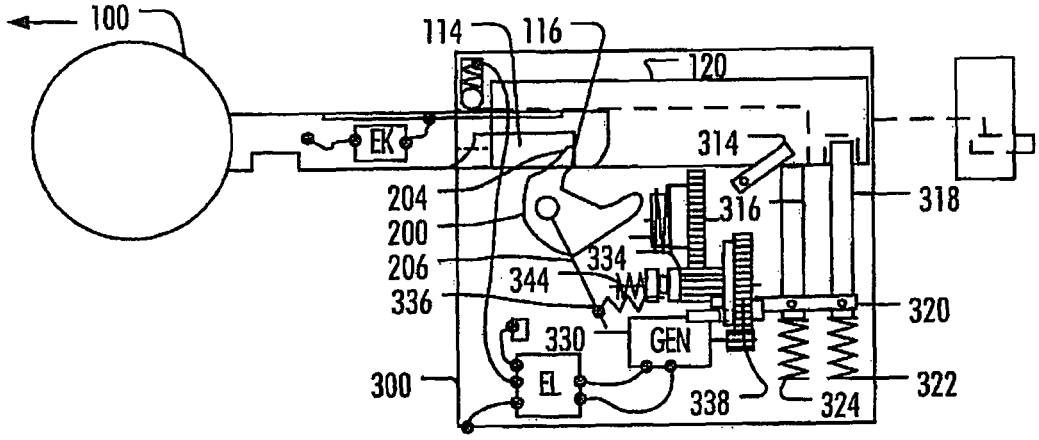

FIG. 2C illustrates the positions and functions of the key follower 200 when the key 100 is withdrawn from the lock 300: the key follower 200 may be returned to the gap 114 position by a spring, whereby the position switch 328 is deactivated and the actuator 330 is reset, and after that the third shape 116 of the key 100 may return the key follower 200 to its home position. FIG. 3J will further illustrate these operations.

FIG. 3A illustrates many other possible components of the lock 300. The lock 300 may further comprise keyways 122, 306, an electric contact 302, a support 342, a driving pin 316, a locking pin 318, a lever 320, an arm 314, springs 322, 324, 344, a threshold device 332, a clutch 334, a main wheel 338, a stopper 340, a position switch 328, a lock cylinder 120, and a clutch opener 336. Furthermore, the lock may be coupled to bolt mechanism 312. The electric generator 330 may rotate through the main wheel 338 when the threshold device 332 is moving, provided that the clutch 334 is closed.

The support 342 may be configured to move by electric power to a fulcrum position provided that the data matches the predetermined criterion, i.e. provided that the data is authenticated. The support 342 may be configured to be reset from the fulcrum position with mechanical power when the key is removed from the lock 300. The mechanical power may be provided by the spring 344, for example.

The locking pin 318 may be configured to hold the lock 300, when engaged, in a locked state, and, when disengaged, in a mechanically openable state. The locking pin 318 may be configured to engage with mechanical power when the key is removed from the lock. The mechanical power may be provided by the spring 322, for example. This is explained below in connection with FIG. 3J. The locking pin 318 may be configured to implement the locked state so that, when engaged, the locking pin 318 holds the lock cylinder 120 stationary, and to implement the mechanically openable state so that, when disengaged, the locking pin 318 releases the lock cylinder 120 rotatable by mechanical power. In the third-class lever the input effort is higher than the output load, but the input effort moves through a shorter distance than the load, i.e. with such lever 320 the locking pin 318 may securely hold the lock cylinder 120 in place in the locked state as the locking pin 318 penetrates deep enough into the wall of the lock cylinder 120. A cavity 310 may be formed in the lock cylinder 120 for the locking pin 318.

The lever 320 may be configured to receive mechanical power, and to output the mechanical power to mechanically disengage the locking pin 318 provided that the support 342 is in the fulcrum position.

The driving pin 316 may be configured to input the mechanical power to the lever 320. The lever 320 may be configured to receive the mechanical power from an insertion of a key. As illustrated in FIG. 3A, the lever 320 may be a third-class lever: the fulcrum is at the left-hand end of the lever 320, the mechanical power is inputted into the middle of the lever 320, and the mechanical power is outputted from the right-hand end of the lever 320.

A coupling 321 between the lever 320 and the locking pin 318 may act as another fulcrum, and the locking pin 318 remains stationary in a locked position provided that the data does not match the predetermined criterion, i.e. provided that the support 342 is not moved to the fulcrum position.

FIG. 3B illustrates the lock status when the first shape 118 of the key 100 is inserted against the first claw 202 in the lock 300. The key electronics 106 may be connected to the electronic circuit 326 so that one electrical connection is made between the electric contact 302 and the slide contact 108, and the other electrical connection between the key body 102 and the lock frame 300.

In FIG. 3C, the key 100 is inserted to a threshold position in the lock 300: the first shape 118 of the key 100 is still in contact with the first claw 202. The threshold device 332 is armed by the swing lever 206. When the key 100 is inserted deeper into the lock, the threshold device 332 is launched and it returns to the home position by a spring. Electric power is produced by the electric generator 330 to the electronic circuit 326 when the threshold device 332 is moving. The threshold device 332 is illustrated in more detail in other applications by the applicant: EP 05 112 272.9 and PCT/FI2006/050543.

In FIG. 3D, the key 100 continues to move into the lock 300. The key follower 200 is not moving because the second claw 204 is in the gap 114 of the key 100: delay is made for the electric power generation and the communication. After a sufficient voltage level is reached, the electronic circuit 326 starts, communicates with the key electronics 106 through the electric contacts 302, 108, and authenticates the key 100.

In FIG. 3E, the second claw 204 is pushed forward by the second shape 110 of the key. The actuator operation is enabled by opening the clutch 334 with the swing lever 206 and the clutch opener 336. The clutch 334 is described in greater detail in another simultaneously filed application: EP 07112677.5.

In FIG. 3F, the actuator enabling operation is started before the power generation phase is ended, i.e. the key 100 may be inserted too fast into the lock 300. In such a case, the actuator operation is disabled, because the clutch 334 may only be opened when it is returned to the home position against to the stopper 340. The lock 300 cannot be opened.

Figure 5A:
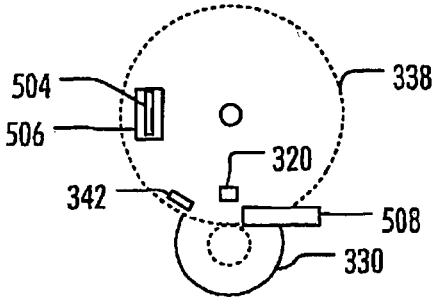
FIGS. 5A, 5B, 5C, 5D, 5E and 5F illustrate an embodiment of an electronic control and mechanical reset of the locking mechanism.
Figure 5B:
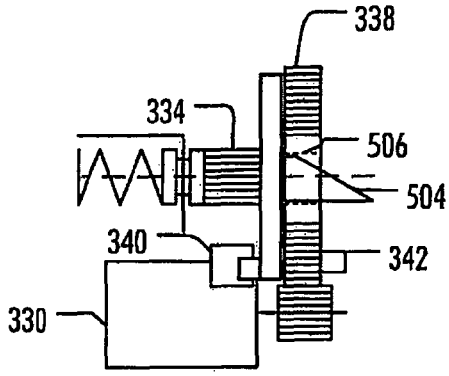

In FIGS. 5A and 5B, the clutch 334 is closed and rotation of the main wheel 338 is blocked by the shapes 504, 506. The main wheel 338 is not rotatable by the electric generator 330, and the support 342 is not set under the lever 320. The locking pin 318 is kept in closed position, even though the driving pin 316 is pushed down by the user of the key 100.

In FIG. 3G, the clutch 334 is opened and the position switch 328 is activated by the second claw 204 and the end of the second shape 110 of the key. The electronic circuit 326 controls the generator 330 as an electric motor when the position switch 328 is activated as follows: the generator 330 is driven in the open direction as illustrated in FIGS. 5E and 5F, if the key 100 is authenticated, and kept in the closed position as illustrated in FIGS. 5C and 5D, if the key 100 is not authenticated.

In FIG. 3H, the main wheel 338 is kept in the closed position. The support 342 is not under the lever 320. The arm 314, the driving pin 316 and the lever 320 are pushed down by the first shape 118 of the key, but the locking pin 318 is kept in the closed position by the spring 322 and the lock 300 cannot be opened. As shown, the lever 320 misses the support 342 (and hence the fulcrum), if the key 100 is not authenticated. The mechanics of the lock 300 remain secure against malicious manipulation.

In FIG. 3I, the main wheel 338 is driven to the open position by the electronic circuit 326. The support 342 is set under the lever 320. The arm 314 and the driving pin 316 are pushed down by the first shape 118 of the key 100, and the locking pin 318 is pushed down through the lever 320 by the driving pin 316. As a result, the lock 300 is in the mechanically openable state, and the bolt mechanism 312 may be moved by rotating the key 100. When the key 100 is rotated, the lock cylinder 120 provides support for the second claw 204 of the key follower 200 so that it keeps its position during rotation. The key 100 has to be returned to the zero position, as illustrated in FIG. 1B, before it may be withdrawn from the lock 300.

Figure 5C:
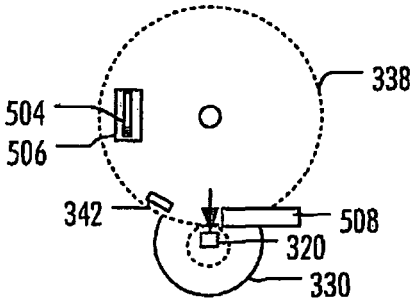
Figure 5D:
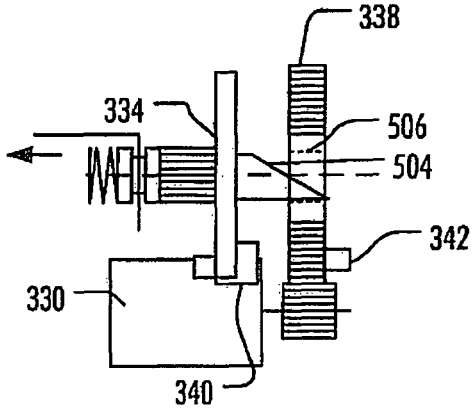
Figure 5E:
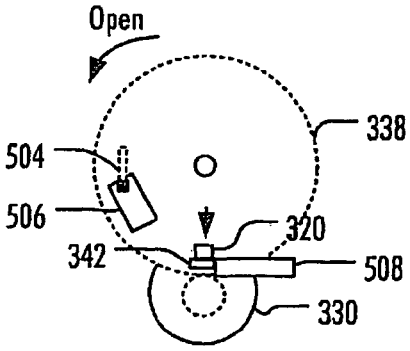
Figure 5F:
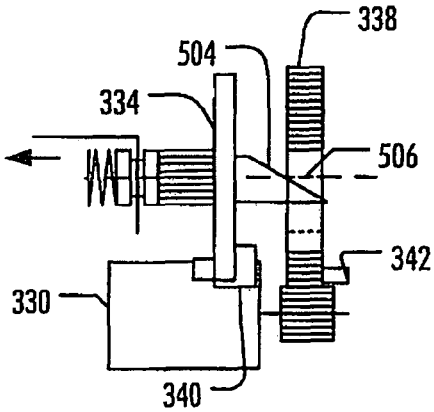

The opening is also illustrated in FIGS. 5C and 5D. The clutch 334 is opened and rotation of the main wheel 338 is enabled by the shapes 504, 506. As further illustrated in FIGS. 5E and 5F, the main wheel 338 is rotated by the electric generator 330 to the stopper 508, the support 342 is set under the lever 320, and the locking pin 318 may be opened by the user of the key 100 through the arm 314, the driving pin 316 and the lever 320.

In FIG. 3J, withdrawal of the key 100 is in progress. The locking pin 318 is returned to the closed position by the spring 322. The driving pin 316 and the arm 314 are returned to their initial positions by the spring 324. The lever 320 is returned to initial position together with the driving pin 316 and the locking pin 318. The clutch 334 is closed by the spring 344 and the main wheel 338 is reset. The second claw 204 is returned into the gap 114 by the clutch opener 336. The third shape 116 of the key 100 and the second claw 204 return the key follower 200 to the starting position as illustrated in FIGS. 3B and 2C, when the key 100 is withdrawn from the lock 300.

Figure 4A:
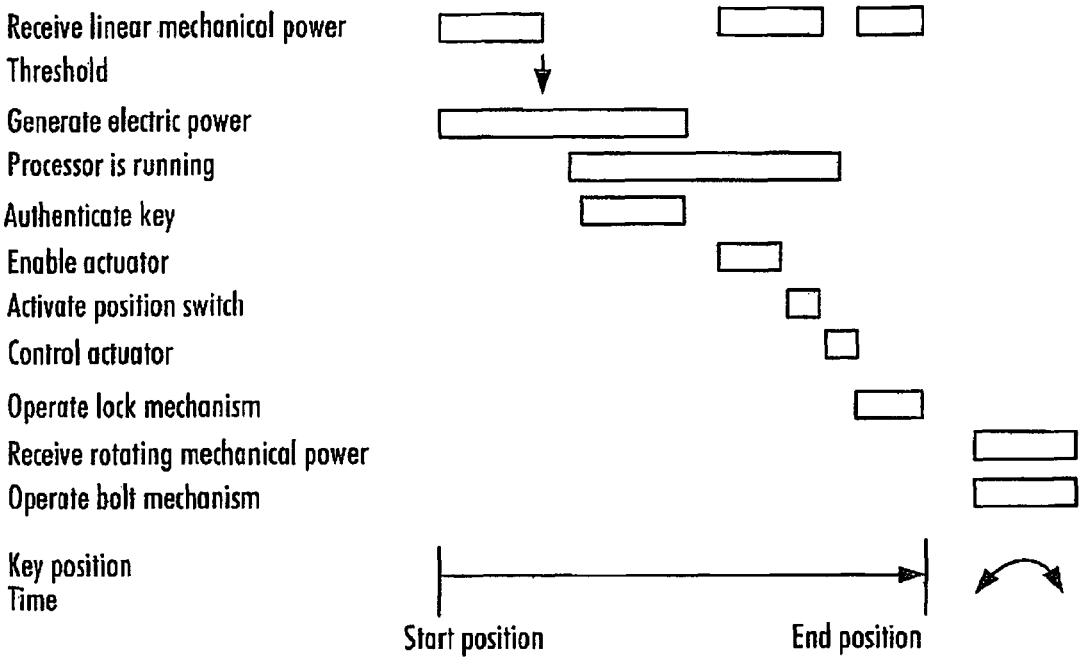
FIGS. 4A and 4B illustrate timing and order of the operations in the electromechanical lock.

FIG. 4A illustrates the order of the lock functions when the key 100 is inserted into the lock 300 in a specified speed. From the key 100 insertion, linear mechanical power is received. Electric power is generated with a part of the received linear mechanical power. A processor of the lock electronics 326 starts when sufficient voltage is generated and it stops when voltage drops below a sufficient level. The key 100 is authenticated with the generated electric power. The actuator is enabled with the mechanical power.

The position switch 328 is activated after the key 100 has been inserted in a required depth. Thereupon, the actuator is controlled with the generated electric power, and the lock mechanism is further operated with the mechanical power. If the insertion speed of the key 100 is so slow that the voltage drops below the sufficient level before the position switch 328 is activated, the actuator 330 is not driven, and the lock 300 remains in the locked state. If the key 100 is inserted too fast, the position switch 328 is activated before the key authentication process is ready, and the lock 300 is kept in the closed state. Finally, rotating mechanical power is received and used to operate the bolt mechanism 312.

Figure 4B:
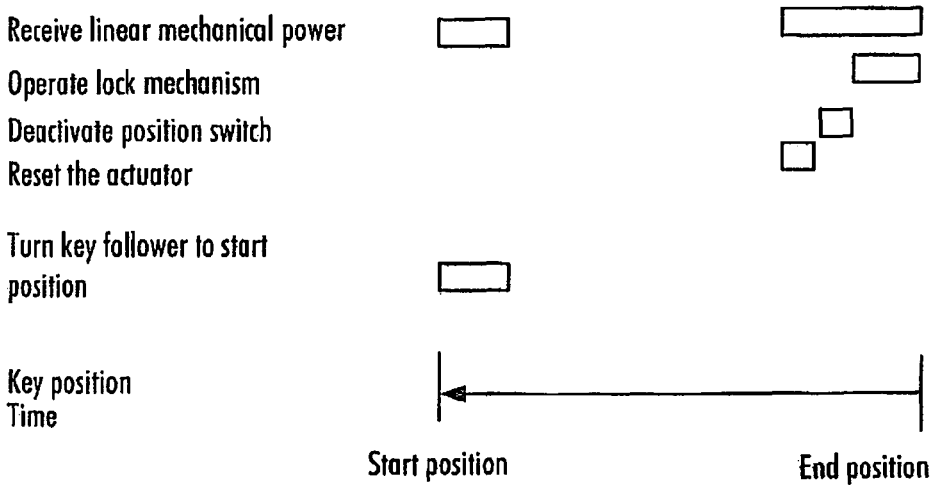

FIG. 4B illustrates the lock functions when the key 100 is withdrawn from the lock 300. Linear mechanical power is received from the key 100 removal. With the received mechanical power, the lock mechanism is operated, and, after the position switch 328 is deactivated, the actuator is reset. Thereupon, the key follower 200 is turned to the start position with the mechanical power.

Figure 6A:
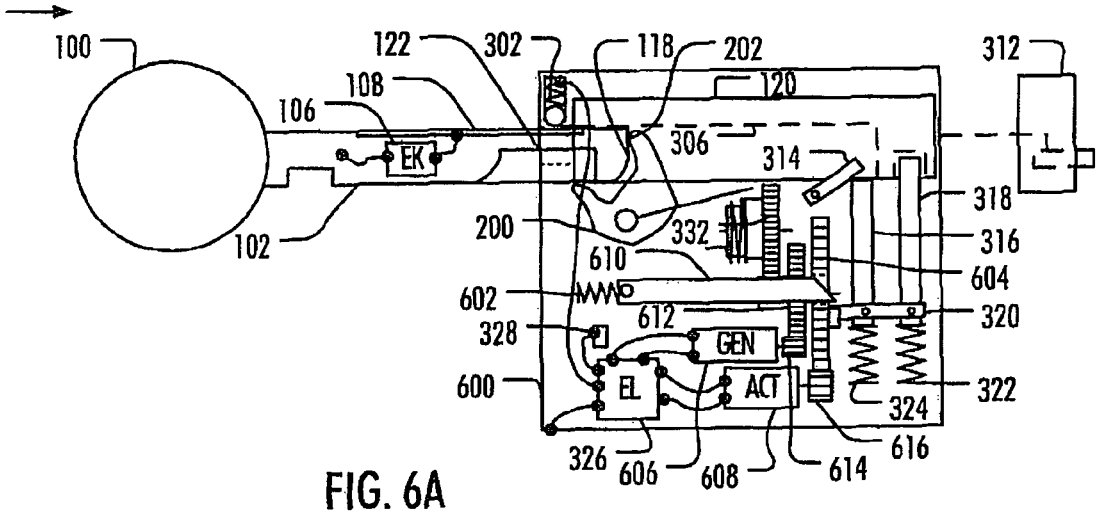
FIGS. 6A, 6B, 6C, 6D, 6E and 6F illustrate an embodiment of a user-powered electromechanical lock with separate generator and actuator devices and its operations.

FIG. 6A illustrates an embodiment of a user-powered electromechanical lock 600 comprising a separate generator 606 and an actuator 608. The generator 606 may be implemented with any suitable technology capable of generating electric power from mechanical power: an electric generator or a piezoelectric generator may be used as the generator 606, for example. The actuator 608 may be implemented with any suitable technology capable of being operated with the electric power so that the lock is set from a locked state to a mechanically openable state: an electric solenoid, a piezoelectric actuator, or an electric motor may be used as the actuator 608, for example.

In FIG. 6A, an electric motor type actuator 606 turns a gear 616 and the support wheel 604. Electric power is generated by the electric generator 606, which may rotate through gears 612, 614 when the threshold device 332 is moving.

The lock 600 may comprise the lock cylinder 120, the keyways 122, 306, the electric contact 302, the key follower 200, the arm 314, the driving pin 316, the locking pin 318, the lever 320, the springs 322, 324, 602, the electronic circuit 326, the position switch 328, a support wheel 604, and a bar 610. Furthermore, the lock 600 may be coupled to the bolt mechanism 312.

FIG. 6A illustrates the lock status when the key 100 is inserted against the first claw 202 of the key follower 200. The key electronics 106 may be connected to the electronic circuit 326 so that one electrical connection is made between the electric contact 302 and the slide contact 108, and the other electrical connection between the key body 102 and the frame of the lock 600. The support wheel 604 is kept in the locked position by the bar 610 and its spring 602. Actuator reset and enable operations are similar to shapes 506 and 504 illustrated in FIGS. 5B, 5D and 5F, but in the embodiment of FIG. 6A the clutch 334 is replaced by the right-hand end of the bar 610 having the shape 504.

Figure 6B:
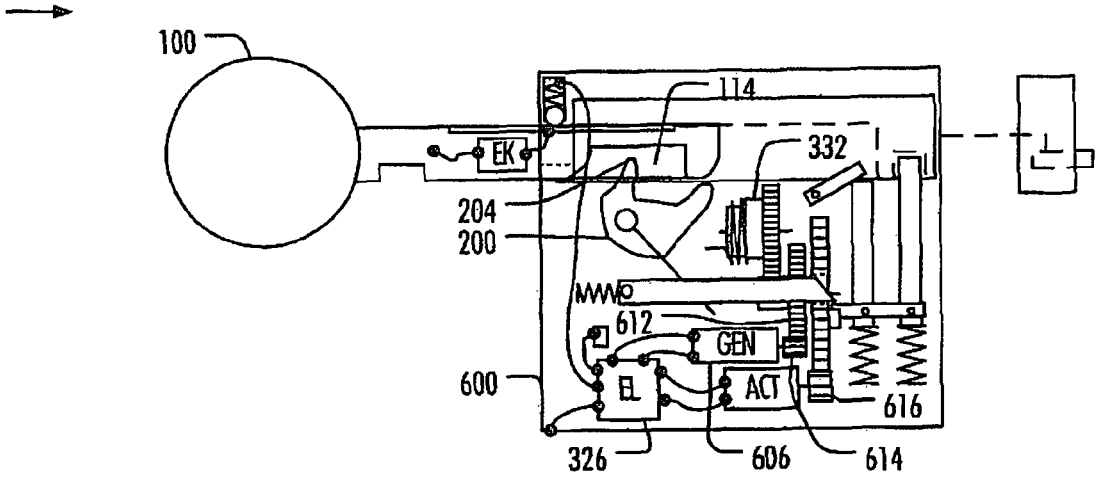

In FIG. 6B, the key 100 is inserted over the threshold position, prior to which the threshold device 332 is armed and launched. Electric power is produced through gears 612, 614 and the threshold device 332 by the generator 606. The electronic circuit 326 is started and communication between the lock 600 and the key 100 is in progress. The key follower 200 is not moving even though the key 100 is moving in, because the second claw 204 of the key follower 200 is in the gap 114 of the key 100. Thereby, time for energy production and key 100 authentication is arranged.

Figure 6C:
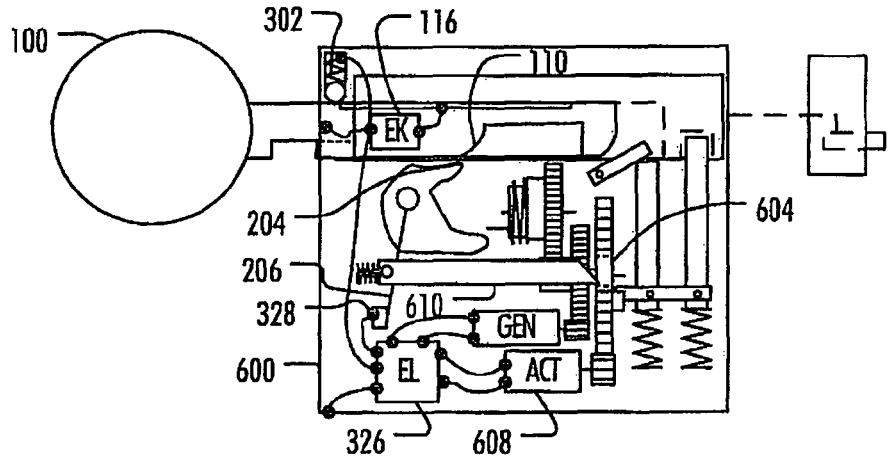

In FIG. 6C, the second claw 204 of the key follower 200 is pushed forward by the second shape 110 of the key 100. The actuator operation is enabled by removing the bar 610 from the support wheel 604 with the swing lever 206. The position switch 328 is activated, the actuator 608 is controlled, and support wheel 604 is turned to open position provided that the key 100 is authenticated. The actuator 608 is kept in the closed position if the key 100 is not authenticated.

Figure 6D:
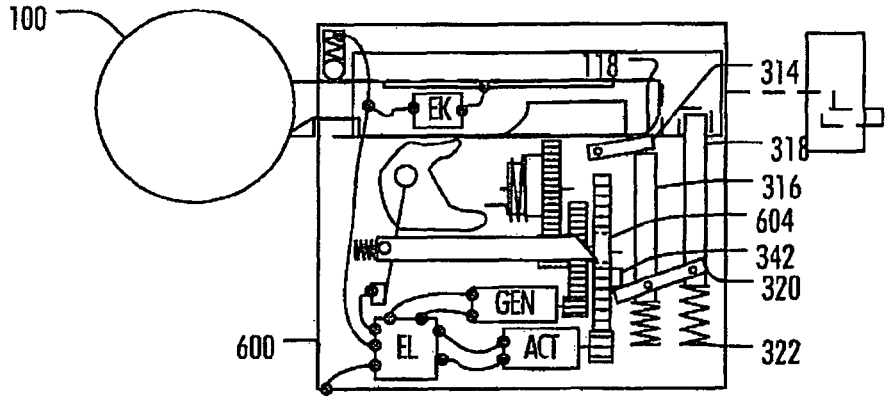

In FIG. 6D, the support wheel 604 is kept in the closed position. The support 342 is not set under the lever 320. The arm 314, the driving pin 316 and the lever 320 are pushed down by the first shape 118 of the key, but the locking pin 318 is kept in the closed position by the spring 322. The lock 600 cannot be opened.

Figure 6E:
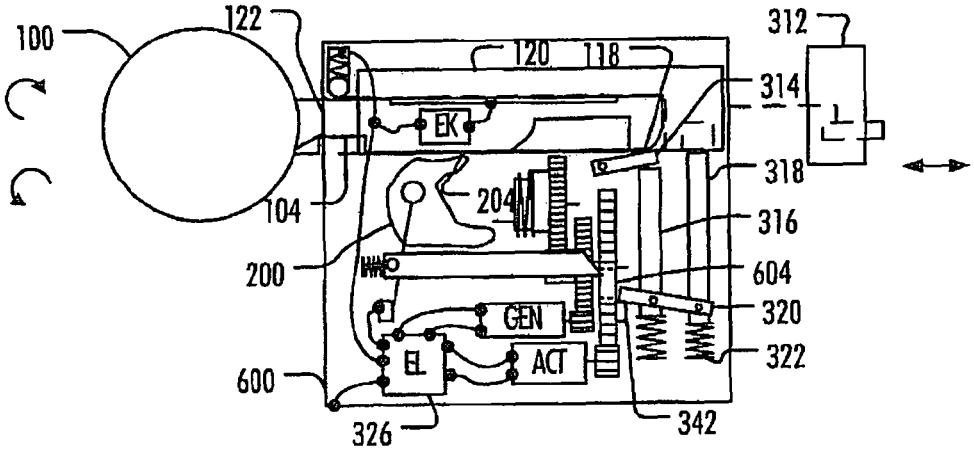

In FIG. 6E, the support wheel 604 is driven to the open position by the electronic circuit 326. The support 342 is set under the lever 320. The arm 314 and the driving pin 316 are pushed down by the first shape 118 of the key, and the lever 320 ejects the locking pin 318 from the lock cylinder 120. The lock 600 is set to the mechanically openable state, and the bolt mechanism 312 may be moved by rotating the key 100. While the key 100 is rotated, the lock cylinder 120 provides support for the second claw 204 of the key follower 200 so that it retains its position during rotation. The key shape 104 and the keyway shape 122 ensure that the key 100 returns to the zero position as illustrated in FIG. 1B before it may be withdrawn from the lock 600.

Figure 6F:
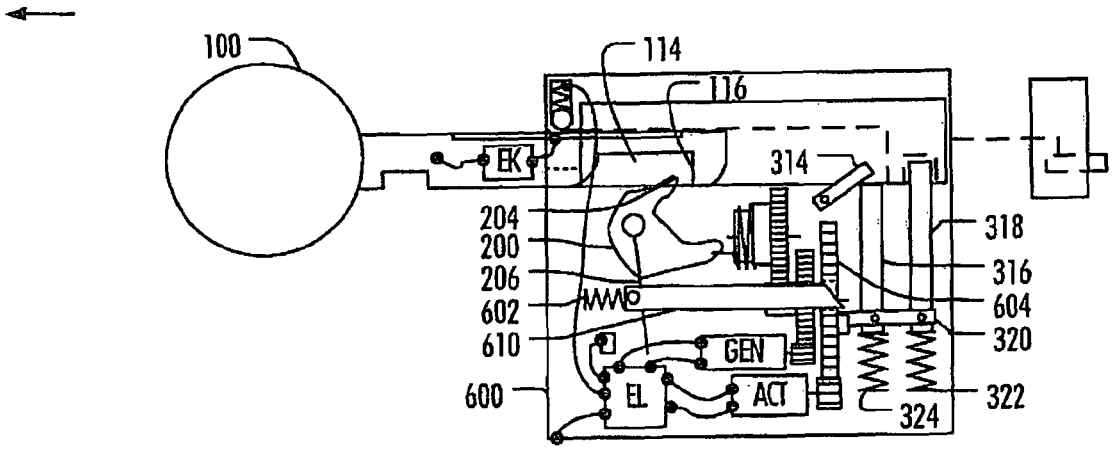

In FIG. 6F, the key 100 withdrawal is in progress. The locking pin 318 is returned to the closed position by the spring 322. The driving pin 316 and the arm 314 are returned to the initial position by the spring 324. The lever 320 is returned to the initial position together with the driving pin 316 and the locking pin 318. The swing lever 206 is pushed backward by the spring 602 and the second claw 204 of the key follower 200 is turned to the gap 114 of the key 100. The bar 610 is pushed by the spring 602 through the support wheel 604 and the support wheel 604 is reset. The third shape 116 of the key 100 and the second claw 204 turn the key follower 200 to the starting position as illustrated in FIGS. 6A and 2C, when the key 100 is withdrawn from the lock 600.

Figure 7A:
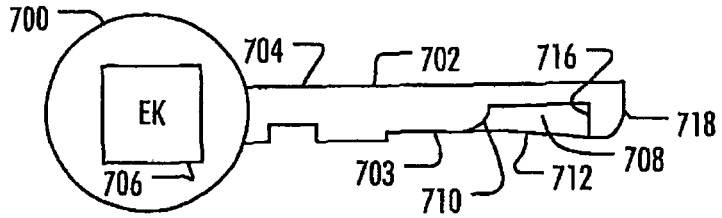
FIG. 7A, 7B and 7C illustrate an embodiment of a key and a key follower returned without a spring load.

FIG. 7A illustrates a key 700 which comprises a key body 702 and key electronics 706. The key body 702 may comprise different shapes: a rotating position shape 704, a first shape 718, a second shape 710 and a third shape 716, a gap 708, a recess 703, and a guide 712. The key electronics 706 may communicate wirelessly with a lock.

Figure 7B:
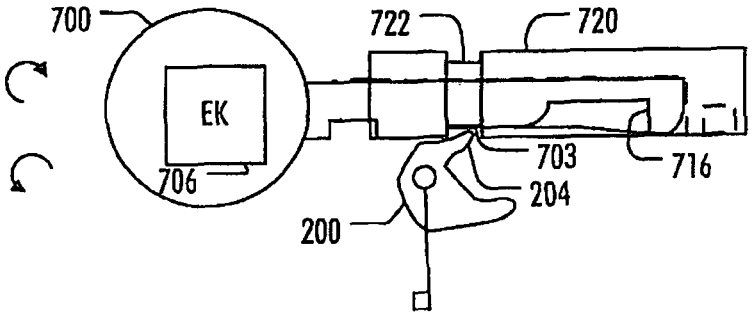

FIG. 7B illustrates the key 700 fully inserted in a lock cylinder 720 comprising a track 722 for the second claw 204 of the key follower 200. The track 722 enables the rotation of the lock cylinder 720. This embodiment illustrates that the key follower 200 may be returned without a spring load when the key 700 is removed from the lock cylinder 720. The second claw 204 of the key follower 200 is configured to protrude from the inner wall of the lock cylinder 720 when the key 700 is fully inserted in the lock cylinder 720. The recess 703 adjacent to the third shape 716 is configured to enable protrusion of (the second claw 204 of) the key follower 200 into the recess 703 so that during a removal phase of the key 700 the third shape 716 contacts with (the second claw 703 of) the key follower 200 and rotates the key follower 200 to the starting position.

Figure 7C:
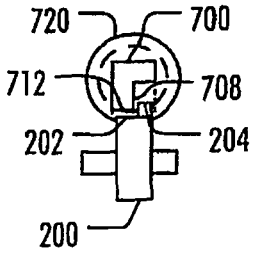

FIG. 7C illustrates a cross-section of the lock cylinder 720 and the key follower 200 when the key 700 is inserted. The guide 712 of the key ensures that the first claw 202 of the key follower cannot drop into the gap 708.

Figure 8:
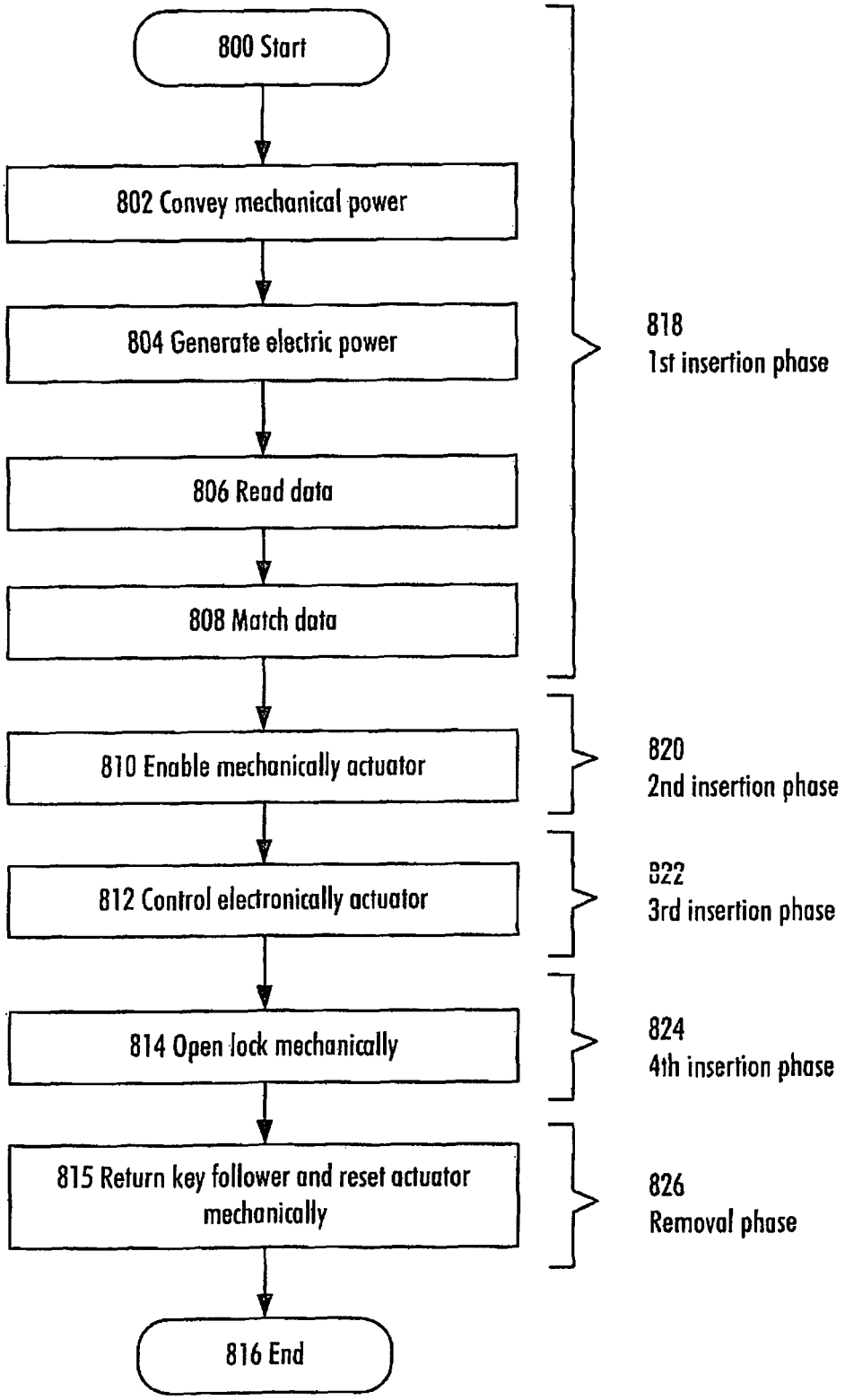
FIG. 8 illustrates a method for operating an electromechanical lock.

Next, a method for operating an electromechanical lock will be described with reference to FIG. 8. Other functions, not described in this application, may also be executed between the operations or within the operations. The method starts in 800.

During a first 818 and a second 820 insertion phases of a key, mechanical power is conveyed to an electric generator by a key follower in 802 and operation of an actuator is mechanically enabled by the key follower in 810. It is to be noted that 802 and 810 may be divided between the first 818 and the second 820 insertion phases as illustrated in FIG. 8, but also another division is possible. An example of the other division is that 810 is executed before 802, i.e. both 810 and 802 are performed in the first insertion phase 818 before 804, 806 and 808, and actually neither of 810 and 802 is performed in the second insertion phase 820

In 804, electric power is generated from mechanical power by the electric generator. In 806, data is read from an external source. In 808, the data is matched against a predetermined criterion. The electric power generation in 804 may continue at least partly in parallel with 806 and possibly also with 808.

During a third insertion phase 822 of the key, the actuator may be electronically controlled to set the lock to a mechanically openable state with electric power provided that the data matches the predetermined criterion in 812.

After that, in 814, the lock may be mechanically opened in a fourth insertion phase 824 of the key. The fourth insertion phase 824 may include the opening of the locking pin by levering it, and the turning of the bolt mechanism after the key has reached the allowed maximum insertion depth.

During a removal phase of the key 826, the key follower is returned to a starting position and the actuator is mechanically reset to the locked state in 815.

The method ends in 816.

The operations described above in FIG. 8 are in no absolute chronological order, and some of the operations may be performed simultaneously or in an order differing from the given one. As was explained earlier, possible operation sequences are: 800-802-804-806-808-810-812-814-815-816, 800-810-802-804-806-808-812-814-815-816, for example. Further variations are also possible, such as 800-802-810-804-806-808-812-814-815-816 and 800-802-804-810-806-808-812-814-815-816, for example.

The method may be enhanced with the embodiments of the electromechanical lock and the key described earlier.

It will be obvious to a person skilled in the art that, as technology advances, the inventive concept can be implemented in various ways. The invention and its embodiments are not limited to the examples described above but may vary within the scope of the claims.

The invention claimed is:

1. An electromechanical lock, comprising:

an electric generator configured to generate electric power from mechanical power;

an electronic circuit, powered by the electric power, configured to read data from an external source, and match the data against a predetermined criterion;

an actuator, powered by the electric power, configured to set the electromechanical lock from a locked state to a mechanically openable state;

a lock cylinder; and a key follower, powered by the mechanical power, configured to organize timing of the electromechanical lock in relation to a movement of a key as follows:

during a first insertion phase and a second insertion phase, convey the mechanical power to the electric generator and mechanically enable operation of the actuator; and during a removal phase of the key, return to a starting position and mechanically reset the actuator to the locked state, wherein the key follower comprises:

a first claw configured to engage with the key during the first insertion phase; and a second claw configured to engage with the key during the second insertion phase, and further configured to protrude from an inner wall of the lock cylinder when the key is fully inserted in the lock cylinder so that during the removal phase of the key the second claw contacts with the key and the key rotates the key follower to the starting position with mechanical power only, and wherein the actuator further comprises a support configured to, during the first insertion phase and the second insertion phase, by the generated electric power, move to a fulcrum position in order to set the lock mechanically from the locked state to the mechanically openable state, and configured to, during the removal phase of the key, by mechanical power, reset the actuator to the locked state.

2. The electromechanical lock of claim 1, wherein the key follower is further configured to, during a third insertion phase, make the electronic circuit electronically control the actuator so as to set the electromechanical lock to the mechanically openable state provided that the data matches the predetermined criterion, and the second claw is further configured to engage with the key during the third insertion phase.

3. The electromechanical lock of claim 1, wherein the lock cylinder is configured to be rotatable from a key insertion position to a lock open position.

4. The electromechanical lock of claim 1, wherein the key follower comprises a rotating key follower.

5. An electromechanical lock and a key of the electromechanical lock, wherein the electromechanical lock comprises:

an electric generator configured to generate electric power from mechanical power;

an electronic circuit, powered by the electric power, configured to read data from an external source, and match the data against a predetermined criterion;

an actuator, powered by the electric power, configured to set the electromechanical lock from a locked state to a mechanically openable state;

a lock cylinder; and a key follower, powered by the mechanical power, configured to organize timing of the electromechanical lock in relation to a movement of a key as follows:

during a first insertion phase and a second insertion phase, convey the mechanical power to the electric generator and mechanically enable operation of the actuator; and during a removal phase of the key, return to a starting position and mechanically reset the actuator to the locked state, wherein the key follower comprises:

a first claw configured to engage with the key during the first insertion phase; and a second claw configured to engage with the key during the second insertion phase, and further configured to protrude from an inner wall of the lock cylinder when the key is fully inserted in the lock cylinder so that during the removal phase of the key the second claw contacts with the key and the key rotate the key follower to the starting position;

the key comprises:

a first shape configured to engage, during the insertion of the key, with the key follower of the electromechanical lock to mechanically transmit mechanical power produced by a user of the electromechanical lock to the electric generator of the electromechanical lock;

a second shape configured to make the electronic circuit of the electromechanical lock electronically control the actuator of the electromechanical lock so as to set the electromechanical lock to a mechanically openable state provided that data read from the external source external to the electromechanical lock matches a predetermined criterion;

a third shape configured to engage, during a removal phase of the key by the user, with the key follower to return the key follower to a starting position and mechanically reset the actuator to the locked state; and a recess adjacent to the third shape configured to enable protrusion of the key follower into the recess so that during the removal phase the third shape contacts with the key follower and rotates the key follower to the starting position with mechanical power only, and the actuator further comprises a support configured to, during the first insertion phase and the second insertion phase, by the generated electric power, move to a fulcrum position in order to set the lock mechanically from the locked state to the mechanically openable state, and configured to, during the removal phase of the key, by mechanical power, reset the actuator to the locked state.

6. The electromechanical lock and the key of the electromechanical lock of claim 5, wherein either the first shape or the second shape is further configured to engage, during the insertion of the key, with the key follower to mechanically enable operation of the actuator.

7. The electromechanical lock and the key of the electromechanical lock of claim 5, wherein the key further comprises an electronic circuit configured to store the data.

8. The electromechanical lock and the key of the electromechanical lock of claim 5, wherein the key is further configured to engage with the lock cylinder of the electromechanical lock and together with the lock cylinder be rotatable from a key insertion position to a lock open position, and the key further comprises a fourth shape configured to engage with the electromechanical lock so that the key is removable from the electromechanical lock only in the key insertion position but not removable from the electromechanical lock in the lock open position.

9. The electromechanical lock and the key of the electromechanical lock of claim 5, wherein the key further comprises a gap, positioned between the first shape and the second shape, configured to provide, during the insertion of the key, a delay in power generation by the electric generator.

10. A method for operating an electromechanical lock, comprising:

providing a key follower with a first claw configured to engage with a key during a first insertion phase, and a second claw configured to engage with the key during a second insertion phase and to protrude from an inner wall of a lock cylinder when the key is fully inserted in the lock cylinder;

during the first and the second insertion phases of the key, conveying mechanical power to an electric generator by the key follower and enabling mechanically operation of an actuator by the key follower;

generating electric power from mechanical power by the electric generator;

reading data from an external source;

matching the data against a predetermined criterion;

during a removal phase of the key, the second claw contacting with the key such that the key rotates the key follower to a starting position with mechanical power only to mechanically reset the actuator to the locked state;

during the first insertion phase and the second insertion phase, moving a support of the actuator, by the generated electric power, to a fulcrum position in order to set the lock mechanically from the locked state to the mechanically openable state; and during the removal phase of the key, the support resetting the actuator to the locked state by mechanical power.

11. The method of claim 10, further comprising:

during a third insertion phase of the key, controlling electronically the actuator to set the electromechanical lock to a mechanically openable state with electric power provided that the data matches the predetermined criterion.

12. An electromechanical lock, comprising:

generating means for generating electric power from mechanical power;

means for reading, powered by the electric power, data from an external source;

matching means for matching, powered by the electric power, the data against a predetermined criterion;

actuating means for setting, powered by the electric power, the electromechanical lock from a locked state to a mechanically openable state;

a lock cylinder; and means for organizing, powered by the mechanical power, timing of the electromechanical lock in relation to an insertion of a key as follows:

during a first insertion phase and a second insertion phase, convey the mechanical power to the generating means and mechanically enable operation of the actuating means; and during a removal phase of the key, return the means for organizing to a starting position and mechanically reset the actuating means to the locked state, wherein the means for organizing comprises:

first engaging means for engaging with the key during the first insertion phase; and second engaging means for engaging with the key during the second insertion phase, and for protruding from an inner wall of the lock cylinder when the key is fully inserted in the lock cylinder so that during the removal phase of the key the second engaging means contacts with the key and the key rotates the means for organizing to the starting position with mechanical power only, and wherein the actuating means further comprises a support configured to, during the first insertion phase and the second insertion phase, by the generated electric power, move to a fulcrum position in order to set the lock mechanically from the locked state to the mechanically openable state, and configured to, during the removal phase of the key, by mechanical power, reset the actuating means to the locked state.

13. The electromechanical lock of claim 12, wherein the means for organizing, during a third insertion phase, make the matching means to electronically control the actuating means to set the electromechanical lock to the mechanically openable state provided that the data matches the predetermined criterion, and the second engaging means is further for engaging with the key during the third insertion phase.

14. An electromechanical lock and a key of the electromechanical lock, wherein the electromechanical lock comprises:

generating means for generating electric power from mechanical power;

means for reading, powered by the electric power, data from an external source;

matching means for matching, powered by the electric power, the data against a predetermined criterion;

actuating means for setting, powered by the electric power, the electromechanical lock from a locked state to a mechanically openable state;

a lock cylinder; and means for organizing, powered by the mechanical power, timing of the electromechanical lock in relation to an insertion of a key as follows:

during a first insertion phase and a second insertion phase, convey the mechanical power to the generating means and mechanically enable operation of the actuating means; and during a removal phase of the key, return the means for organizing to a starting position and mechanically reset the actuating means to the locked state, wherein the means for organizing comprises:

first engaging means for engaging with the key during the first insertion phase; and second engaging means for engaging with the key during the second insertion phase, and for protruding from an inner wall of the lock cylinder when the key is fully inserted in the lock cylinder so that during the removal phase of the key the second engaging means contacts with the key and the key rotate the means for organizing to the starting position; and the key comprises:

first means for engaging, during the insertion of the key, with a key follower of the electromechanical lock to mechanically transmit mechanical power produced by a user of the electromechanical lock to an electric generator of the electromechanical lock;

second means for making an electronic circuit of the electromechanical lock electronically control an actuator of the electromechanical lock so as to set the electromechanical lock to a mechanically openable state provided that data read from a source external to the electromechanical lock matches a predetermined criterion; and third means for engaging, during a removal phase of the key by the user, with the key follower to return the key follower to a starting position and mechanically reset the actuator to the locked state; and means adjacent to the third means for engaging, for enabling protrusion of the key follower into the means adjacent to the third means for engaging so that during the removal phase the third means for engaging contacts with the key follower and rotates the key follower to the starting position with mechanical power only, wherein the actuating means further comprises a support configured to, during the first insertion phase and the second insertion phase, by the generated electric power, move to a fulcrum position in order to set the lock mechanically from the locked state to the mechanically openable state, and configured to, during the removal phase of the key, by mechanical power, reset the actuating means to the locked state.

15. The electromechanical lock and the key of the electromechanical lock of claim 14, wherein the key further comprises means for engaging, during the insertion of the key, with the key follower to mechanically enable operation of an actuator of the electromechanical lock.

16. The electromechanical lock of claim 2, wherein the lock cylinder is configured to be rotatable from a key insertion position to a lock open position.

* * * * *